US007270237B2

(12) United States Patent
Mandeltort

(10) Patent No.: US 7,270,237 B2
(45) Date of Patent: Sep. 18, 2007

(54) WATERPROOF DOCUMENT STORAGE DEVICE

(75) Inventor: Stanley T. Mandeltort, Lincolnshire, IL (US)

(73) Assignee: Stanely T. Mandeltort, Lincolnshire, IL (US)

( * ) Notice: Subject to any disclaimer, the term of this patent is extended or adjusted under 35 U.S.C. 154(b) by 282 days.

(21) Appl. No.: 10/626,263

(22) Filed: Jul. 24, 2003

(65) Prior Publication Data

US 2005/0016888 A1 Jan. 27, 2005

(51) Int. Cl.

| | |
|---|---|
| ***B65D 85/48*** | (2006.01) |
| ***G09F 3/18*** | (2006.01) |
| ***A47G 1/06*** | (2006.01) |
| ***B42F 13/00*** | (2006.01) |

(52) U.S. Cl. ..... 206/455; 40/661; 40/661.09; 40/771; 402/79; 402/80 P

(58) Field of Classification Search ..... 206/449, 206/455–456; 40/661, 661.09, 673, 771–776; 402/79, 80 R, 80 P, 502; 383/95, 99, 106
See application file for complete search history.

(56) References Cited

U.S. PATENT DOCUMENTS

| | | | | |
|---|---|---|---|---|
| 2,283,026 | A * | 5/1942 | Yates | 206/449 |
| 2,542,206 | A * | 2/1951 | Kemp et al. | 426/404 |
| 2,650,444 | A * | 9/1953 | Coyle et al. | 40/661 |
| 2,986,144 | A * | 5/1961 | Shepard | 40/772 |
| 3,279,331 | A * | 10/1966 | Platt | 493/189 |
| 3,762,630 | A | 10/1973 | Braznell | |
| 4,244,762 | A | 1/1981 | Holson | |
| 4,502,599 | A * | 3/1985 | Perecman | 206/554 |
| 4,711,347 | A | 12/1987 | Drexler et al. | |
| 4,761,903 | A * | 8/1988 | Cantrell | 40/773 |
| 4,838,708 | A * | 6/1989 | Holcomb et al. | 383/5 |
| 5,161,827 | A | 11/1992 | Grosso | |
| 5,372,429 | A | 12/1994 | Beaver, Jr. et al. | |
| 5,954,431 | A | 9/1999 | Fabel | |
| 6,012,844 | A | 1/2000 | Huseman et al. | |
| 6,139,210 | A * | 10/2000 | Nelson et al. | 402/79 |
| 6,164,859 | A * | 12/2000 | Hambright | 402/79 |
| 6,183,158 | B1 | 2/2001 | Lynton | |
| 6,266,907 | B1 | 7/2001 | Matteau et al. | |
| 6,390,714 | B1 | 5/2002 | Bradley et al. | |
| 6,675,518 | B1 * | 1/2004 | Porteous | 40/701 |
| 2002/0116854 | A1 * | 8/2002 | Rappaport et al. | 40/776 |

FOREIGN PATENT DOCUMENTS

EP 0363092 A2 * 4/1990

* cited by examiner

*Primary Examiner*—Bryon P. Gehman
(74) *Attorney, Agent, or Firm*—Marshall, Gerstein & Borun LLP

(57) ABSTRACT

A document storage apparatus for safely storing photographs or other documents includes a first transparent sheet and a second sheet attached to the first transparent sheet along a water or air tight seal. The water or air tight seal defines a pocket between the first transparent sheet and the second sheet and that has an open end. A water or air tight adherent is disposed between the first transparent sheet and the second sheet and across the open end of the pocket, and is adapted to selectively adhere the first sheet to the second sheet to thereby allow the pocket to be sealed in a water or air tight fashion. An attachment section can be disposed along a side of the first and second sheet and can be adapted to mount the storage apparatus within a container.

28 Claims, 7 Drawing Sheets

WATERPROOF DOCUMENT STORAGE DEVICE

FIELD OF THE DISCLOSURE

The present disclosure relates to a device to store and protect documents, and more specifically, to a waterproof and air-tight device adapted to store and display photos and documents.

BACKGROUND

It is common for people to store documents and collectibles in a fashion that is easy to display and view and that is also easy to store. In particular, people take photographs of events and store these photos in photo album sheets or pages that are disposed in loose leaf books. A person looking at the photos can page through the book to view many pictures. However, there are presently no products available for storing the photos in a photo sheet in a way that ensures the safety of the photos from exposure to smoke and water or other types of detrimental gases and liquids.

Several devices have been used or are in current use for the storage and display of photos in photo albums. In a first example, photo corner supports are glued onto a page. The corners of the photos are then inserted into the corner supports, and the photo is held on the page by its corners. In another example, two transparent sheets are heat sealed together along substantially parallel lines to form at least one pocket with two open ends. The first open end can be blocked by the binder of a loose leaf notebook. A photo can be inserted and retracted through the second open end. These examples are problematic in that the photos are not protected from the environment. Debris and liquid, such as a spilled drink or smoke, can easily contact and damage a photo while a person is looking at the photo stored and displayed in the book. Furthermore, photos stored in these photo albums are subject to water and smoke damage in the case of a fire or flood.

In another example, a paper page is coated in adhesive, and a flexible transparent sheet is releasably disposed on the page. To use this photo page, a consumer must lift the sheet, place a photo on the page with adhesive, and then reapply the sheet to the page to activate the adhesive. In this configuration, if the adhesive is too strong, it will bond too severely to the photo, and the photo can be ripped if the photo is removed. If the adhesive is not strong enough, the sheet will not bond to the page, and the photo can become exposed. In practice, the adhesive generally is too strong at first, then, as the album is used, and some of the adhesive wears away or becomes dirty, the adhesive becomes too weak.

In another example, documents are stored in sheet protectors, generally a pair of 8½"×11" or 12"×12" sheets secured along three edges to define a pocket in between. The sheets are typically made from transparent plastic film—either polypropylene or polyvinylchloride. These sheet protectors are also used for memory scrapbooks by crafters, who make creative and intricate items that can be slipped into the pocket between the sheets. The sheets can be fitted for loose leaf binders and have an opening along the top for inserting the document. As with the photo page, there is no protection against water or smoke.

Thus, there is still a need for a page that is easy to use and that can safely store documents in a way that will not cause damage to the documents, but that will protect the document from water and smoke.

SUMMARY

The disclosed apparatus addresses these problems by providing a photo album sheet or document protector for safely storing photographs or documents in a water tight fashion. The photo album sheet includes a first transparent sheet and a second sheet attached to the first transparent sheet along a water tight seal which defines a pocket between the first transparent sheet and the second sheet, the pocket having an open end. An adherent is disposed between the first transparent sheet and the second sheet and across the open end of the pocket, and is adapted to selectively adhere the first sheet to the second sheet to seal the pocket in a liquid tight fashion. An attachment section can be disposed along a side of the first and second sheet and is adapted to mount the photo album sheet within a photo album.

A consumer wishing to protect a photograph or other document, while still wishing to be able to enjoy the photograph, can insert the photograph through the open end of the pocket into the water-tight pocket formed by the seal between the first and second sheets. The consumer can then seal the open end of the pocket in a water tight fashion with the photograph inside. Finally, the consumer can dispose the photo album sheet or document protector in a photo album or other document holder.

In this manner, a photo album page can be used to store and display photographs or other documents such that the documents are protected from water and smoke.

DETAILED DISCLOSURE

Figure 1:
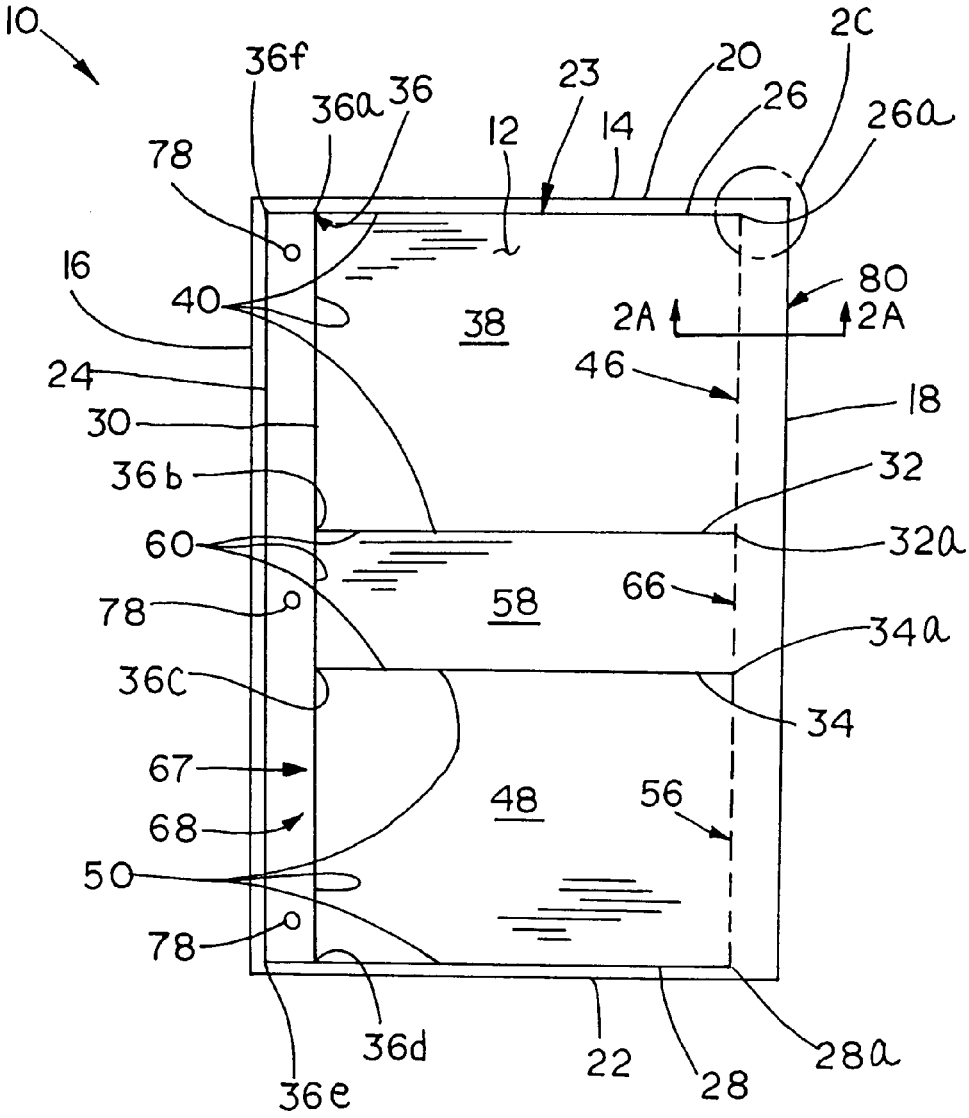
FIG. 1 depicts a layout view of a photo album sheet according to the teachings of this disclosure.

Referring now to the drawings, FIG. 1 illustrates a document protector generally depicted by the reference numeral 10. In this example, the document protector 10 is configured as and will be referred to as a photo album sheet, or simply a photo sheet, to hold and protect photos. However, it is clear that other documents such as diplomas, wills, contracts, titles, etc., could be stored in the document protector 10. The photo album sheet 10 includes a first sheet 12 disposed over and facing a second sheet 14. The photo album sheet 10 has a left edge 16, a right edge 18, a top edge 20, and a bottom edge 22.

At least the first sheet 12 and usually the second sheet 14 may be formed of any numerous organic, synthetic, or processed material that is transparent, which materials are well known in the art, but which can include, acetate, cast polypropylene or polyvinylchloride, or the like. The first and second sheets 12, 14 should be tough enough to withstand the normal use of inserting and removing photos and are preferably flexible.

The photo sheet 10 includes a series of seams, generally denoted by reference numeral 23, between the first sheet 12 and the second sheet 14 that secure the sheets 12 and 14 together. Specifically, a left seam 24 is disposed adjacent the left edge 16, a top seam 26 is disposed adjacent the top edge 20, and a bottom seam 28 is disposed adjacent the bottom edge 22. The photo album sheet 10 further includes a vertical seam 30 substantially parallel to and right of the left seam 24, and a first middle seam 32 and a second middle seam 34, both disposed substantially parallel to and between the top seam 26 and the bottom seam 28.

The seams 23 meet each other at intersection points, generally denoted by reference numeral 36. Specifically, the top seam 26 intersects the vertical seam 30 at a first intersection point 36*a*. The photo sheet 10 further includes second, third, fourth, fifth and sixth intersection points 36*b*, 36*c*, 36*d*, 36*e*, and 36*f*. Because there is no seam adjacent the right edge 18, the top seam 26, the bottom seam 28, the first middle seam 32, and the second middle seam 34 have free ends 26*a*, 28*a*, 32*a*, 34*a*, respectively.

A first pocket 38 is formed by the top seam 26, the vertical seam 30, the first middle seam 32, the first intersection point 36*a*, and the second intersection point 36*b*. Accordingly, the first pocket 38 has a three sided seal 40 and an open end 46. Similarly, a second pocket 48 is formed by the bottom seam 28, the vertical seam 30, the second middle seam 34, the third intersection point 36*c*, and the fourth intersection point 36*d*. Thus, the second pocket 48 has a three sided seal 50 and an open end 56. A third pocket 58 is formed by the first middle seam 32, the vertical seam 30, the second middle seam 34, the second intersection point 36*b*, and the third intersection point 36*c*. Thus, the third pocket has a three sided seal 60 and an open end 66.

The seams 23 between the first sheet 12 and the second sheet 14 are preferably water and air tight. Further, the seams 23 intersect at the intersection points 36 which are also preferably water and air tight. This configuration ensures that the pockets 38, 48, 58 are sealed in water and air tight fashion along three sides. If all of the seams 23 are water tight, the three pockets 38, 48, 58 are all sealed from each other. However, either the first middle seam 32 or the second middle seam 34 or both can be non-water or air tight, and at least one pocket is still formed.

An attachment section 67 is formed along the left edge 16 of the photo album sheet 10. As will be described later, the attachment section 67 can be used to attach the sheet 10 to a photo album or other type of book or holder such as a ring binder. In this example, the attachment section 67 is a chamber 68 formed by the top seam 26, the vertical seam 30, the bottom seam 28, the left seam 24, the first intersection point 36*a*, the fourth intersection point 36*d*, the fifth intersection point 36*e*, and the sixth intersection point 36*f*. As will be understood, the chamber 68 is completely sealed along the seams 24, 26, 28, 30, although this is not necessary. A series of holes 78 can be disposed through the photo sheet 10 in the attachment section 67. The holes 78 can be sized and spaced to receive the binders of a loose leaf notebook, for example. Because the chamber 68 is in itself a pocket sealed on all four sides, it is sealed from the first, second and third pockets 38, 48, 58. Thus, any debris or contaminents that may enter the chamber 68 through the through holes 78 cannot enter any of the first, second, or third pockets 38, 48, 58.

Figure 2:
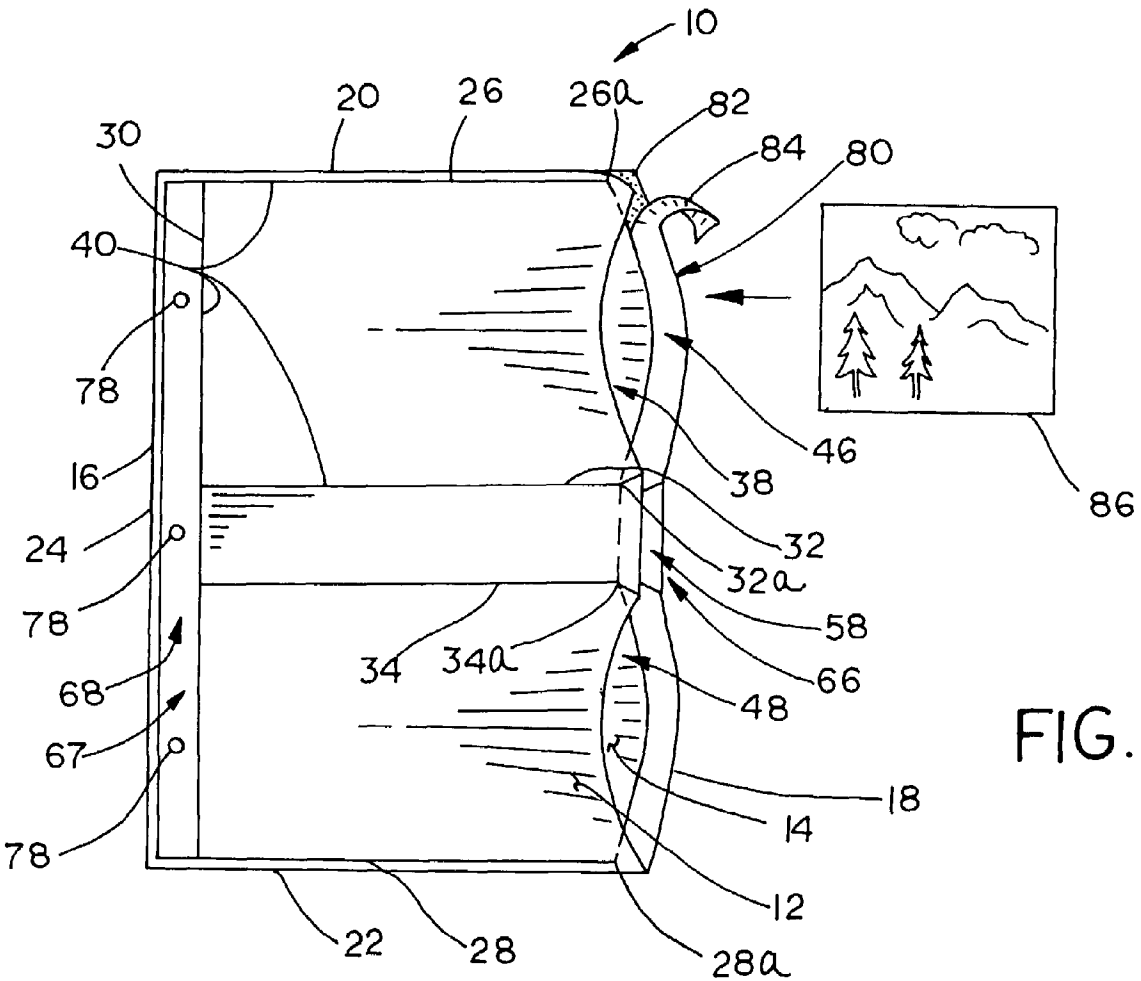
FIG. 2 depicts a photo being inserted into the photo album sheet of FIG. 1.

As illustrated in FIGS. 1 and 2, a selectable adherent 80 is disposed adjacent the right edge 18. The selectable adherent 80 adjoins the free ends 26*a*, 28*a*, 32*a*, 34*a* of the top seam 26, the bottom seam 28, the first middle seam 32, and the second middle seam 34. In this example, the selectable adherent 80 includes an adhesive 82 disposed on the second sheet 14, and a releasable tape 84 disposed on the adhesive 82. In other examples, the adhesive 82 may include pressure activated or heat activated adherents known in the art.

The adherent 80 is used to selectively seal the open ends 46, 56, 66 of the first, second, and third pockets 38, 48, 58. The adherent 80 is adapted to seal the first pocket 38 by bonding the first sheet 12 to the second sheet 14 in water or air tight fashion across the open end 46 from the free end 26*a* of the top seam 26 to the free end 32*a* of the first middle seam 32. This operation creates a completely closed and water or air tight pocket 38. The adherent 80 seals the second pocket 48 and the third pocket 58 in a similar fashion.

Figure 3:
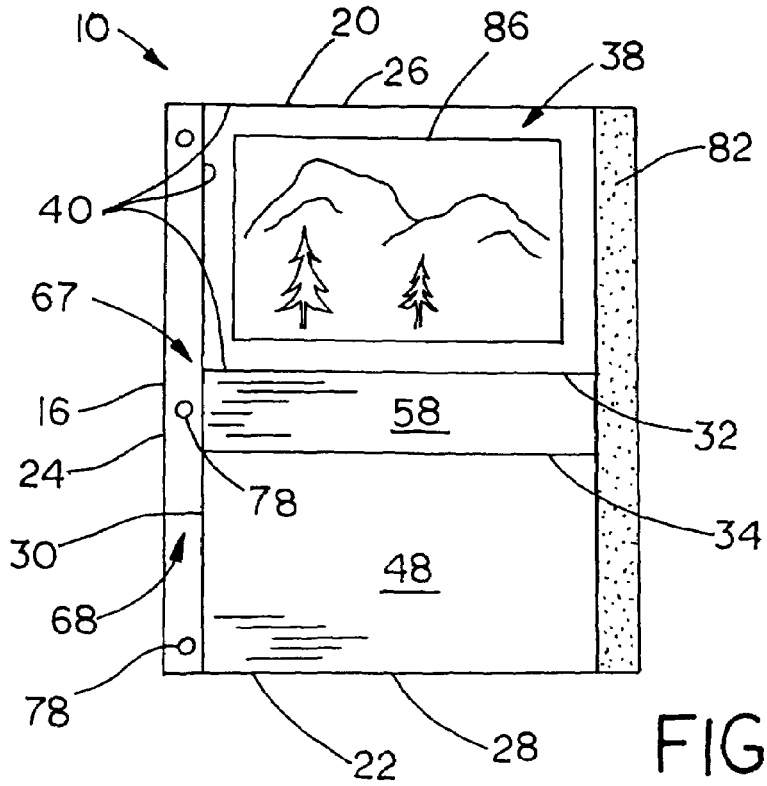
FIG. 3 depicts a photo residing in the photo album sheet of FIG. 1.

As shown in FIGS. 2 and 3, to use the photo sheet 10, the open end 46 of the first pocket 38, for example, is opened by pulling the first sheet 12 apart from the second sheet 14 near the open end 46. A photo 86 can then be inserted into the first pocket 38. To seal the open end 46, the releasable tape 84 is removed from the second sheet 14 to expose the adhesive 82. Pressure is then applied across the open end 46 such that the adhesive 82 bonds the first sheet 12 to the second sheet 14. Because the adhesive 82 adjoins the free ends 26*a*, 32*a* of the top seam 26 and first middle seam 32, a four sided completely sealed pocket 38 is formed. This sequence can be repeated for the second pocket 48 and the third pocket 58.

Figure 2A:
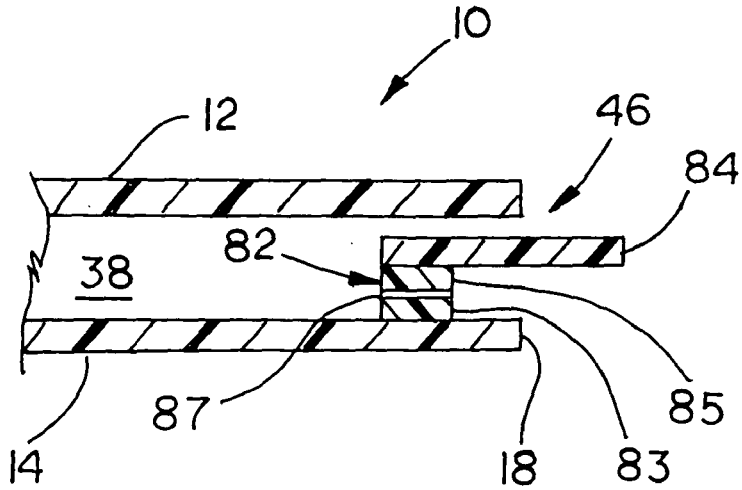
FIG. 2A depicts a fragmentary cross section view of the photo album sheet taken along line 2A-2A in FIG. 1, with the panels shown prior to the releasable tape being removed.
Figure 2B:
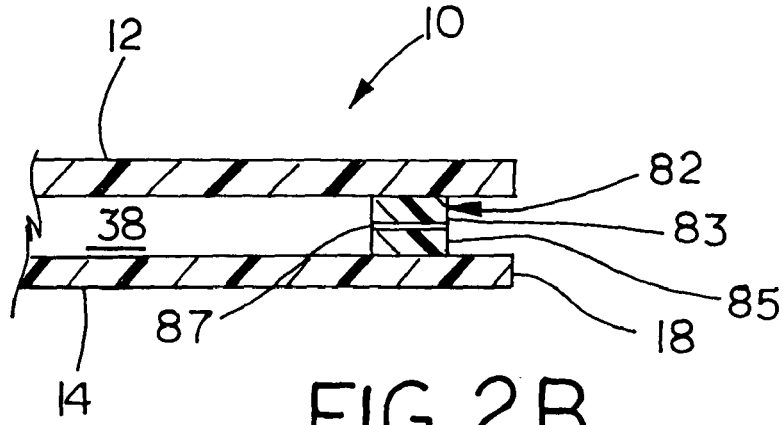
FIG. 2B depicts the fragmentary cross section of FIG. 2A, with the tape being removed and the sheets adhered together.

An example of a selectable adherent 80 is depicted in cross section in FIGS. 2A and 2B. The adhesive 82 may include two layers including a first aggressive adhesive 83, and a second nonaggressive adhesive 85 disposed on either side of a thin tape 87. The aggressive adhesive 83 creates a permanent attachment to the second layer 14. The nonaggressive adhesive 85 is releasably attached to the tape 84. Once the user removes the tape 84 from the nonaggressive adhesive 85, the nonaggressive adhesive 85 can be secured to the first sheet 12 in a water or air tight fashion, as is shown in FIG. 2B. Because the layer 85 is nonaggressive, (i.e. less aggressive), the user can pull the first sheet 12 apart from the nonaggressive adhesive 85, thereby re-opening the open end 46 of the pocket 38.

In this example, the tape 84 is disposed extending out past the right side 18 of the photo sheet 10. This facilitates the user grasping the tape and pulling it off the adherent 80. Further, the adhesive 82 is shown to be disposed inside the right side 18 of the photo sheet 10. This can be helpful in that when the first sheet 12 is secured to the second sheet 14 by the adhesive 82, portions of the first sheet 12 and second sheet 14 extend past the adhesive 82. This allows the user to easily grasp the first sheet 12 and second sheet 14 to pull them apart, if the user would like to re-open the end 46 of the pocket 38.

Figure 2C:
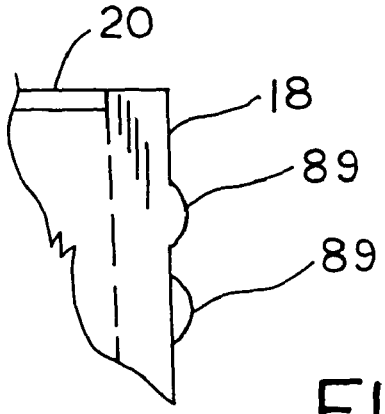
FIG. 2C depicts an alternative example of the right edge of the photo album sheet including tabs, taken from circle 2C in FIG. 1.

An alternative example of the right side 18 of the photo sheet 10 is depicted in FIG. 2C. In this example, the first sheet 12 and the second sheet 14 each include a tab 89. The tabs 89 allow the user to easily grasp the first sheet 12 and the second sheet 14 and pull them apart to open the pockets 38, 48, and 58. While both sheets 12 and 14 are shown to include a tab 89, only one sheet could have a tab 89, or the sheets 12 and 14 could have multiple tabs 89, for example a set of tabs 89 for each pocket 38, 48, 58. The tabs 89 can be offset from on another as shown in FIG. 2C, or could be aligned with one another.

Accordingly, the first, second, and third pockets 38, 48, 58 can be sealed in a water or air tight fashion to store photos or other documents. Thus, the pockets 38, 48, 58 can be used to store and display any number of items, including, but not limited to, documents, photo negatives, postcards, coupons, certificates, awards, or other flat or thin memorabilia or keepsakes that can be placed between two sheets and displayed. In this example, the first and second pockets 38, 48 can be either approximately 4 inches tall by 6 inches wide, or 3½ inches tall by 5 inches wide for the most common size of photographs. Further, the third pocket 58 can be sized to receive photographic negatives from a 35 mm camera. These sizes are for illustration only, as other sizes can be used as well. Further, the seams 23 and the adherent 80 may take on any number of shapes and sizes to define a pocket 38 with water or air tight seams 23 and an open end 46 that is selectively adherably closeable to form a completely sealed pocket 38. Further, the sheet 10 can include more or less pockets 38, 48, 58.

Figure 4:
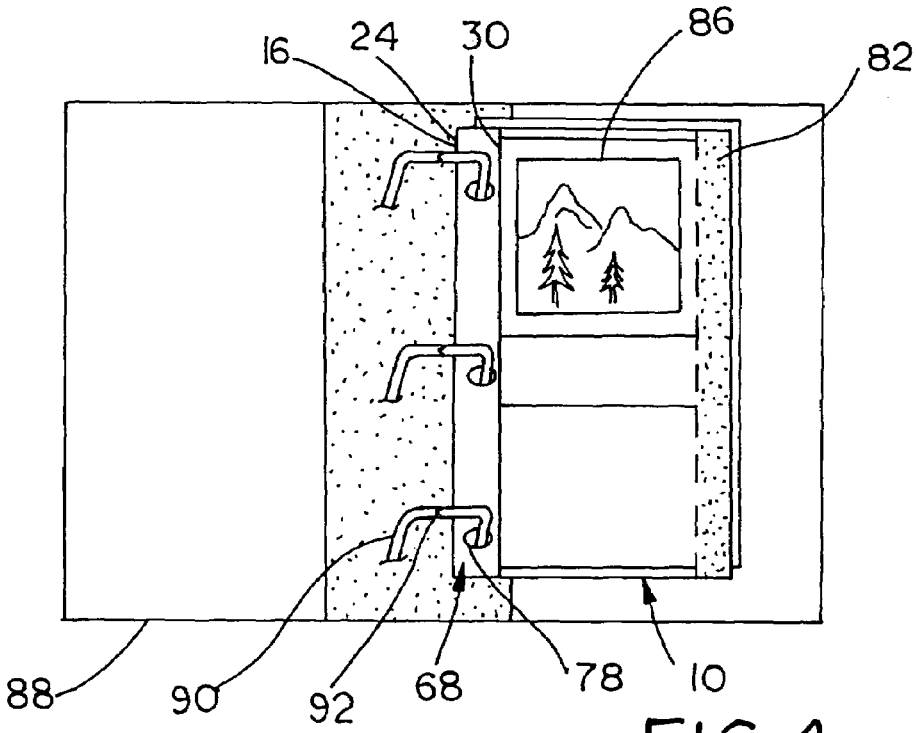
FIG. 4 depicts a photo album including the photo album sheet of FIG. 1.

As is shown in FIG. 4, the sheet 10 may be placed into a container 88 adapted to receive the sheet 10. In this example, the container 88 is depicted as and will be referred to as a loose leaf binder. Other containers, such as bound books, could be used in conjunction with the sheet 10. In this example, the loose leaf binder 88 is configured as a photo album. The loose leaf binder 88 may be of standard construction and in this example includes three separable rings 90, and is known as a three ring binder. The rings 90 can separate along respective joints 92 to open and receive the sheets 10 through the holes 78. The rings 90 can then be closed again to lock the sheets 10 in place. Of course, fewer or more holes 78 can be employed depending on the particular loose leaf binder 88 with which the sheet 10 is to be paired. Although a standard three ring binder is shown, any binder that can releasably secure sheets can be used.

In this example, a sealed chamber 68 with holes 78 is disclosed as the attachment section 67. However, the attachment section 67 can comprise other structures, such as a pair of flaps, a single flap, a chamber 68 without holes, etc. The attachment member 67 can be used to attach the sheet 10 to a spine of a book in any permanent or releasable method known in the book bindery or photo album arts. Thus, other methods of attaching the sheet 10 to a book will be apparent to those skilled in the art.

Figure 5:
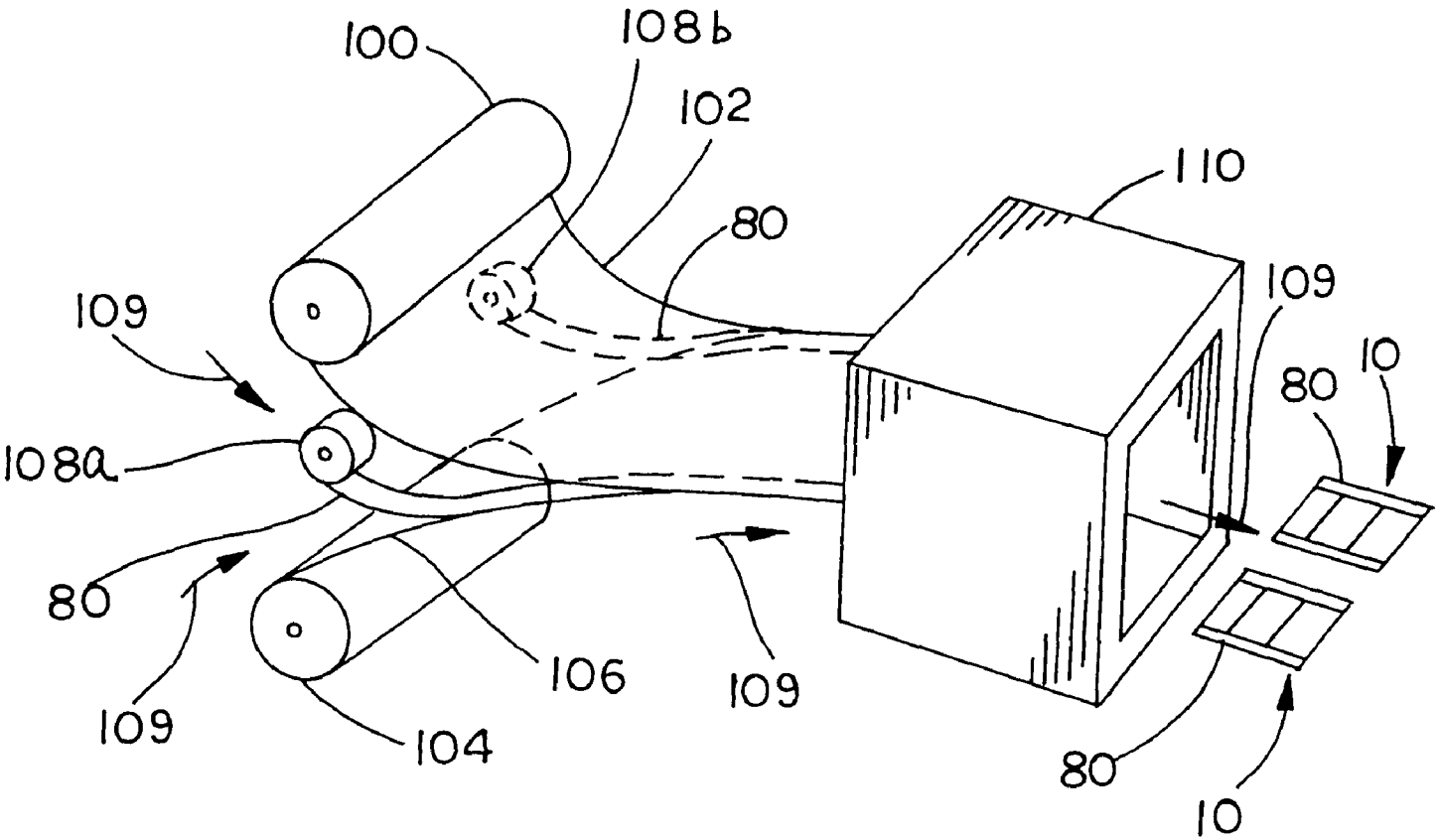
FIG. 5 depicts a manufacturing process for the photo album sheet of FIG. 1.

The sheet 10 can be formed in any of several manners. As depicted in FIG. 5, the first sheet 12 may be heat sealed to the second sheet 14. To perform this function, a first roll 100 includes a first material 102 that will ultimately form the first sheet 12. A second roll 104 includes a second material 106 that will form the second sheet 14. A first tape roll 108*a* and a second tape roll 108*b* include the adherent 80 and the releasable tape 84 and are disposed on opposite ends of the first roll 100 and the second roll 104.

The materials 102, 106 and adherents 80 are pulled under tension through a sealer 110 in the direction of arrows 109. The sealer 110 applies localized heat to the first sheet 12 and the second sheet 14 to form the seams 23 and applies pressure to bond the adherent 80 to the second material 106. In heat sealing, the sheets 12, 14 are made of compatible materials such that when heat is applied, the materials flow together. As the materials cool, the sheets 12, 14 are bonded together, and a water or air tight seal is formed. The first and second materials 102, 106 are then cut into individual photo sheets 10. In this example, two photo sheets 10 are formed simultaneously with adherents 80 being on opposite sides. In other examples, only a single photo sheet 10 is formed at a time.

In a second example, a permanent adhesive well known in the art can used. The permanent adhesive is disposed on either the first or second sheet 12, 14 along the locations that the seams 23 are to be formed. The sheets 12, 14 are then placed together such that the adhesive bonds the two sheets 12, 14 together along the seams 23.

In a third example, the sheets 12, 14 can be sonically welded together to form the seams 23. With sonic welding, the sheets 12, 14 are subjected to high-frequency sound waves which vibrate the sheets along the seams 23 to cause friction and high, focused heat. This heat actually melts or welds the sheets together. This process is very clean and allows for a strong, nearly unbreakable bond to be formed.

Figure 6:
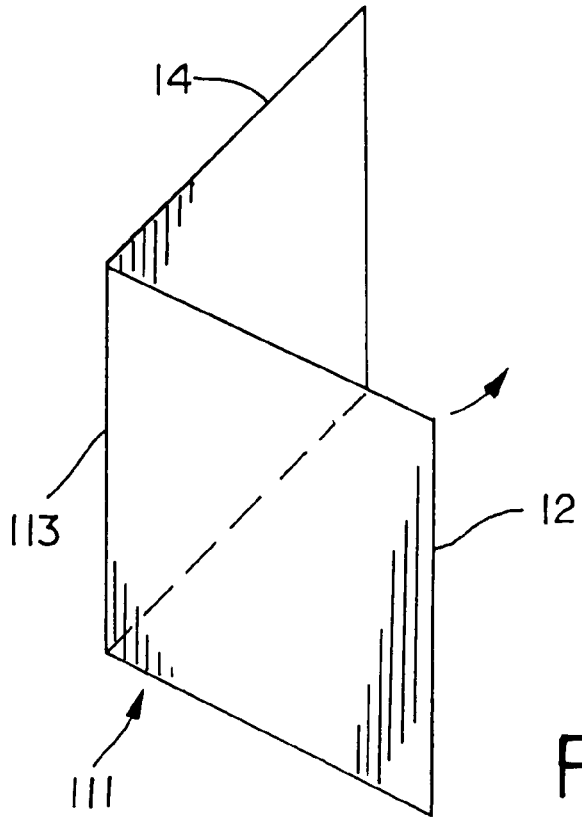
FIG. 6 depicts an alternate manufacturing process for the photo album sheet of FIG. 1.

In another example shown in FIG. 6, a single sheet 111 can be folded over itself to form the first sheet 12 and the second sheet 14. In this example, the fold line 113 can serve as a seam 23. After folding, the sheets 12, 14 can be secured to form the pockets 38, 48, 58 in any known method including those previously described.

The holes 78 can then be cut from the photo sheet 10 by any method known, such as punching. Alternatively, the holes 78 can be cut from each individual sheet 12, 14 before the sheets 12, 14 are bonded together. However, by cutting the holes 78 after the sheets are bonded, the chance that the holes 78 in each of the sheets 12, 14 will be misaligned is lessened.

Figure 7:
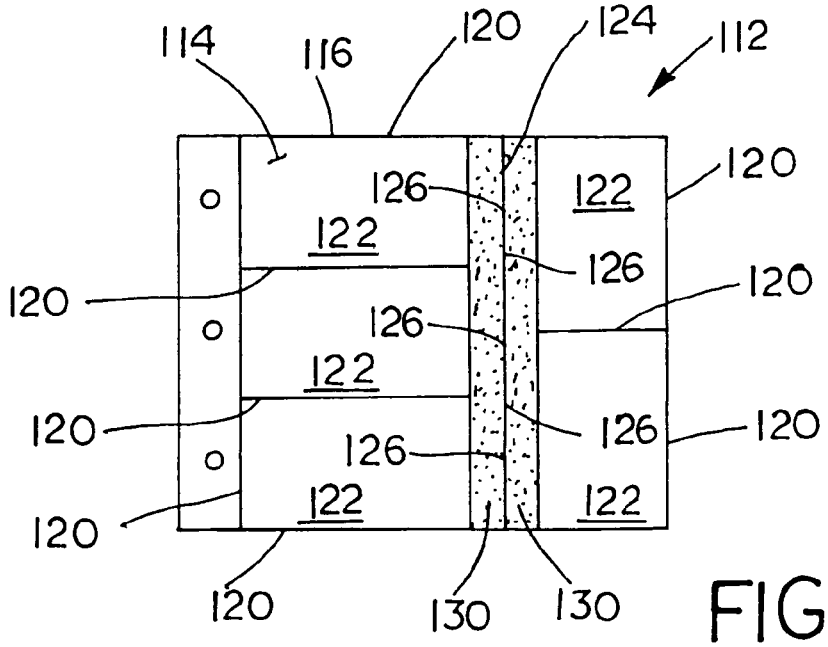
FIG. 7 depicts a second example of a photo album sheet.

Another example of a photo album sheet 112 is depicted in FIG. 7. The photo sheet 112 includes a first sheet 114 and a second sheet 116 directly underneath the first sheet 114. The first sheet 114 is fastened to the second sheet 116 along seams 120, which define a set of pockets 122. A slit 124 is cut in the first sheet 114 to define open ends 126 in the pockets 122. A releasable adherent 130 is disposed along the open ends 126, similar to the first example. In this example, a total of five pockets are shown. Thus, a photo can be inserted into a pocket 122 along the slit 124 in the first sheet 114 by pulling the first sheet 114 away from the second sheet 116 to expose the open edge 126 adjacent the desired pocket 122.

Figure 8:
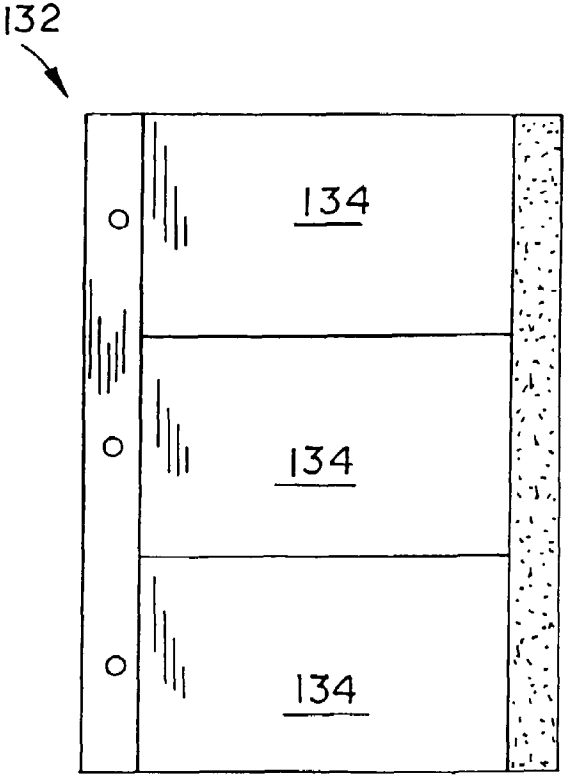
FIG. 8 depicts a third example of a photo album sheet.

FIG. 8 depicts a still further example of a photo sheet 132. The photo sheet 132 is similar to the photo sheet 10 except that it has three equal sized pockets 134. These pockets 134 can be sized to receive a 4"×6" picture, a 3½"×5" picture, or any other size of picture or keepsake.

Figure 9:
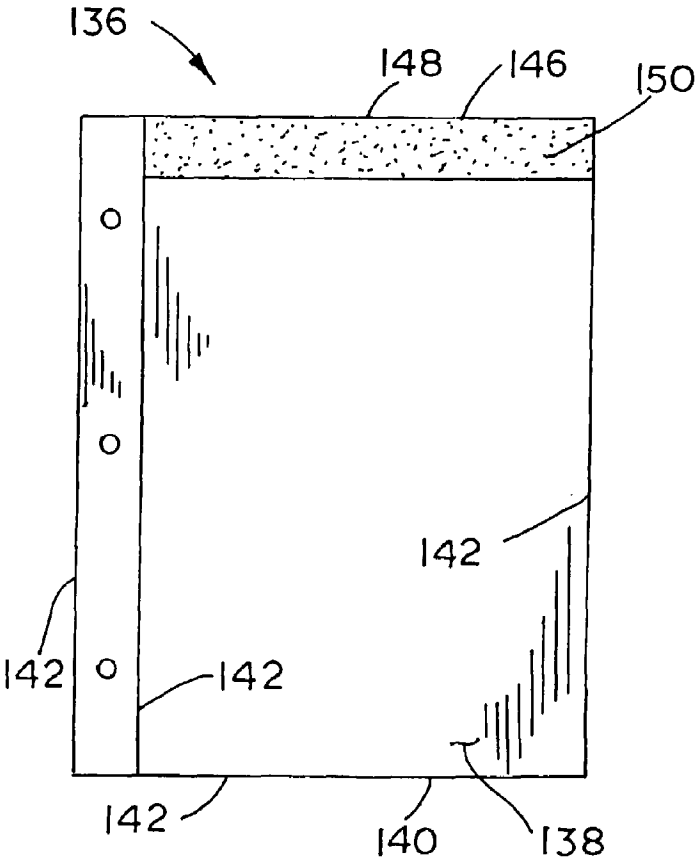
FIG. 9 depicts an example of a document protector.

FIG. 9 depicts an example of a document protector 136. The document protector 136 includes a first sheet 138 and a second sheet 140 fastened together along seams 142 which define a pocket 144 with an open end 146 at a top edge 148. A releasable adherent 150 is disposed along the open end 146 as in the previous examples. The pocket 144 is sized to receive a document which can be 8½"×11", 12"×12", or any other size that a person may find useful. The document protector 136 can be used to store important documents such as wills, titles, or keepsakes such as crafts.

In other examples not shown, decorative or supportive paper could be placed between the first sheet 12 and second sheet 14 in the pockets. This could help to add to the interest of the picture or even provide a frame for the picture. The paper can be either placed in the pockets 38, 48, 58 loosely or held therein by a friction fit. In another example, a sheet of paper can be placed between the sheets 12, 14 prior to assembly. The paper would have openings placed strategically thereon, and the sheets 12, 14 could be heat sealed together through these holes, thereby locking the paper in place between the sealed sheets.

In another example, the first sheet 12 and the second sheet 14 could be separated by a third sheet (not shown) sandwiched in between the first sheet 12 and the second sheet 14. In this example, the first sheet 12, the second sheet 14 and the third sheet are all be bonded together along the seams 23 to form the pockets 38, 48, 58. However, the third sheet serves as a divider within the pockets. In this example, two photos could be stored within a pocket 38 such that the third sheet keeps the two photos separated.

In a still further example, the document protector 10 could be used to store items that must remain untouched. For example, it is important that evidence in a criminal proceeding not be tampered with. In this example, the document protector 10 could include pockets 38, 48, 58 with a larger storage capacity. This can be accomplished by including pleated sides on the front and back sheets 12, 14 or other methods known in the art.

Further, in this example (or in the previous examples), it may be desireable for the pockets to remain permanently closed to ensure that the contents remain untouched. As such, an adherent 80 that only includes an aggressive adhesive can be employed to permanently seal the open edge. This can also be accomplished by disposing an aggressive adhesive on both sides of the thin tape 87. In this manner, evidence can be held within the pockets 38, 48, 58 in a tamper proof manner. The evidence can only be handled by breaking open either the first sheet 12 or the second sheet 14. This way, it can be known that evidence has not be compromised, and it is known if evidence has been handled.

From the foregoing, one of ordinary skill in the art will appreciate that the present disclosure sets forth a device for a transparent, water tight sheet for storing photographs. However, one of ordinary skill in the art could readily apply the novel teachings of this disclosure to any number of situations such as the storage and display of other memorabilia and keepsakes. As such, the teachings of this disclosure shall not be considered to be limited to the specific examples disclosed herein, but to include all applications within the spirit and scope of the invention.

I claim:

1. A storage apparatus for safely storing documents, comprising:

a first transparent sheet;

a second sheet attached to the first transparent sheet along a permanent waterproof seal, the permanent waterproof seal including a continuous seam defining a pocket between the first transparent sheet and the second sheet, the pocket having an open end, the seam including a first endpoint and a second endpoint;

a length of adherent disposed on one of the first transparent sheet and the second sheet and across the open end of the pocket and contacting the first endpoint and the second endpoint, wherein when the other of the first transparent sheet and the second sheet contacts the adherent across the open end of the pocket, the continuous seam and the adherent form a waterproof pocket; and a releasable tape disposed on the adherent such that the adherent is adapted to selectably adhere the first transparent sheet to the second sheet across the open end; and an attachment section disposed along a side of the first and second sheet and adapted to mount the storage apparatus within a container.

2. The storage apparatus of claim 1, wherein the seal is air tight.

3. The storage apparatus of claim 1, wherein the seal is a heat seal between the first sheet and the second sheet.

4. The storage apparatus of claim 1, wherein the second sheet is transparent.

5. The storage apparatus of claim 1, wherein the continuous seam includes a first linear segment, a second linear segment, and a third linear segment.

6. The storage apparatus of claim 5, wherein the first linear segment extends approximately horizontally across the first sheet, the second linear segment extends approximately vertically across the first sheet, and the third linear segment extends approximately horizontally across the first sheet.

7. The storage apparatus of claim 6, wherein the pocket forms an approximately 4 inch by 6 inch rectangle.

8. The storage apparatus of claim 6, wherein the pocket forms an approximately 3½ inch by 5 inch rectangle.

9. The storage apparatus of claim 1, further comprising a second seal between the first sheet and the second sheet, the second seal defining a second pocket with an open end.

10. The storage apparatus of claim 9, wherein the adherent is disposed across the open end of the second pocket.

11. The storage apparatus of claim 10, wherein the second pocket is approximately 4 inches by 6 inches.

12. The storage apparatus of claim 10, wherein the second pocket is sized to receive a strip of negatives from a 35 mm camera.

13. The storage apparatus of claim 1, wherein the attachment section is a chamber bounded by a continuous watertight seal.

14. The storage apparatus of claim 13, wherein the chamber includes a plurality of holes sized and spaced such that the storage apparatus can be received in a loose leaf binder.

15. The storage apparatus of claim 1, wherein the adherent is releasable.

16. The storage apparatus of claim 1, wherein the first sheet and the second sheet are comprised of a single sheet folded over itself.

17. The storage apparatus claim 1, wherein the adherent includes an aggressive adhesive and a nonaggressive adhesive disposed on either side of a tape.

18. The storage apparatus of claim 17, wherein the aggressive adhesive is adhered to the second sheet, and a releasable tape is disposed across the nonaggressive adhesive, thereby separating the nonaggressive adhesive from the first sheet.

19. A method of manufacturing a device for safely storing a document, including:

attaching a first sheet to a second sheet along a permanent liquid tight seal to form an open ended pocket between the first sheet and the second sheet, the permanent liquid tight seal comprising a continuous scam having a first endpoint and a second endpoint; and disposing a length of adherent on the first sheet and across the open end of the pocket, wherein the length of adherent contacts the first endpoint and the second endpoint, wherein when the second sheet contacts the adherent across the open end of the pocket, the continuous seam and the adherent form a waterproof pocket;

disposing a releasable tape on the adherent such that the adherent is adapted to selectably adhere the first sheet to the second sheet; and forming an attachment section next to the pocket, the attachment section adapted to mount the two sheets to a photo album.

20. The method of claim 19, wherein attaching the first sheet to the second sheet includes heat sealing the first sheet to the second sheet.

21. The method of claim 19, wherein disposing the adherent includes using a dual sided tape.

22. The method of claim 21, wherein the dual sided tape includes an aggressive adhesive and a non-aggressive adhesive.

23. The method of claim 21, wherein the dual sided tape includes a pair of aggressive adhesives.

24. The method of claim 21, wherein the adherent includes a releasable tape.

25. A storage apparatus for safely storing documents, comprising:

a first transparent sheet;

a second sheet attached to the first transparent sheet along a permanent liquid tight seal, the permanent liquid tight seal including a vertical seam and two horizontal seams meeting at corners to define a three-sided pocket between the first transparent sheet and the second sheet, the pocket having an open end, the horizontal seams each having endpoints opposite the vertical seam;

an attachment section disposed along a side of the first and second sheet and adapted to mount the storage apparatus within a container;

an adhesive disposed on one of the first and second sheets and across the open end of the pocket and contacting the endpoints of the horizontal seams, wherein when the other of the first and second sheet contacts the adhesive across the open end, the vertical seam, the horizontal seams, and the adhesive form a waterproof pocket; and a releasable tape disposed on the adhesive such that the adhesive is adapted to selectably adhere the first sheet to the second sheet across the open end.

26. The apparatus of claim 25, wherein the attachment section is a chamber defined by a continuous water-tight seal.

27. The apparatus of claim 25, wherein the adhesive includes a dual sided tape with a non-aggressive adhesive disposed on a first side of the tape, and an aggressive adhesive disposed on the second side of the tape.

28. The apparatus of claim 25, wherein the permanent seal between the first and second sheets is one of a heat seal, permanent adhesive, and sonic weld.

* * * * *